US009731894B2

(12) United States Patent
Tatom

(10) Patent No.: US 9,731,894 B2
(45) Date of Patent: Aug. 15, 2017

(54) PNEUMATIC TRASH CAN

(71) Applicant: Patrick Alan Tatom, Conroe, TX (US)

(72) Inventor: Patrick Alan Tatom, Conroe, TX (US)

( * ) Notice: Subject to any disclaimer, the term of this patent is extended or adjusted under 35 U.S.C. 154(b) by 151 days.

(21) Appl. No.: 14/491,008

(22) Filed: Sep. 19, 2014

(65) Prior Publication Data

US 2016/0083183 A1 Mar. 24, 2016

(51) Int. Cl.
*B65D 25/14* (2006.01)
*B65F 1/06* (2006.01)

(52) U.S. Cl.
CPC ..... *B65F 1/068* (2013.01); *B65F 1/065* (2013.01); *B65F 2210/129* (2013.01); *B65F 2210/132* (2013.01); *B65F 2210/137* (2013.01); *B65F 2210/179* (2013.01); *Y10S 220/908* (2013.01); *Y10S 220/9081* (2013.01); *Y10S 220/9083* (2013.01)

(58) Field of Classification Search
CPC ..... B65F 1/068; B65F 1/065; B65F 1/0163; B65F 1/06; B65F 1/14; B65F 2210/129; B65F 2210/132; B65F 2210/137; B65F 2210/179; Y10S 220/908; Y10S 220/9081; Y10S 220/9083
USPC .... 220/495.01, 495.04, 495.06, 495.08, 908, 220/90.1, 908.2
See application file for complete search history.

(56) References Cited

U.S. PATENT DOCUMENTS 6,000,571 A * 12/1999 Brooks ..... B65F 1/06 220/495.04
9,027,778 B1 * 5/2015 Slawinski, Jr. ..... B65F 1/06 220/495.04
2004/0238541 A1 * 12/2004 Camp, Jr. ..... B65F 1/06 220/495.04
2006/0175336 A1 * 8/2006 Wang ..... B65F 1/06 220/495.04
2014/0084008 A1 * 3/2014 Conway ..... B65F 1/065 220/495.04

* cited by examiner

*Primary Examiner* — Fenn C Mathew
*Assistant Examiner* — Elizabeth Volz
(74) *Attorney, Agent, or Firm* — AdamsIP, LLC; J. Hunter Adams; Stephen Thompson

(57) ABSTRACT

A pneumatic trash can having a built-in air blower system is provided. The air blower system facilitates ease of placement and removal of a flexible trash bag within the trash can. The blower system is designed to evacuate air from the interior of the trash can and to blow air into the interior of the trash can. The trash can additionally has a drainage system designed to drain any liquids that may leak from a trash bag in order to keep the liquids away from the blower system.

14 Claims, 3 Drawing Sheets

PNEUMATIC TRASH CAN

FIELD OF THE INVENTION

The present invention refers generally to a trash can and, more specifically, to a trash can having a built-in air blower system to facilitate ease of placement and removal of a flexible trash bag within the trash can.

BACKGROUND

Trash cans are typically lined with flexible trash bags that can be placed into the trash can, filled with trash, and then removed from the trash can. The purpose of using a trash bag is so that all of the trash can be easily transferred out of the trash can once the can is filled. However, it is often difficult to place an empty trash bag into the trash can because of air that becomes trapped between the outer surface of the trash bag and the interior surface of the trash can walls. When the air becomes trapped, it is difficult to get the flexible bag to conform to the surface of the trash can walls. Doing so typically requires the person positioning the bag in the trash can to bend over and reach down as far as possible into the trash can.

In addition, it is often difficult to remove a full trash bag from the trash can. Once the bag is filled with trash, the bag conforms to the surface of the trash can walls around the entire circumference of the trash can, which creates a partial vacuum at the bottom of the trash can as the trash bag is lifted out of the can. The vacuum causes the person lifting the bag to have to hold the bag of trash, which is often very heavy, longer than otherwise necessary in order to allow the trash can to slowly slide away from the bag.

Therefore, both placing an empty bag into the can and removing a filled bag from the can are difficult tasks. This is particularly true in the case of very large trash cans and large trash bags, which are commonly used in businesses such as bars and restaurants. With large trash cans, it is difficult to reach all the way down to the bottom of the can to force out the trapped air and position the bag. Likewise, when a large bag is filled, often with heavy items such as bottles, it becomes very heavy, thus making it difficult to hold the bag for an extended period of time while the can slowly slides away from the bag.

In addition, flexible trash bags sometimes leak due to objects within the bag puncturing holes in the bag. Any liquid contained within the bag will then escape and fill the bottom of the trash can or leak onto undesired areas as the trash bag is transferred from the can to a different location. This problem is particularly relevant for business such as bars and restaurants, which often have significant amounts of liquid in the trash due to customers disposing of partially filled drinks.

Accordingly, a need exists in the art for an improved trash can designed to make it easier for a person to both place an empty bag in the can and remove a filled bag from the can. Furthermore, a need exists in the art for an improved trash can that can drain liquids away from the trash can.

SUMMARY

A preferred embodiment of the invention is directed generally to an improved trash can and, more specifically, to a trash can having a built-in air blower system to facilitate ease of placement and removal of a flexible trash bag within the trash can.

In a preferred embodiment, the trash can is comprised of a container for receiving and holding trash having a bag stop disposed within the container and attached to the side walls of the container. In a preferred embodiment, the bag stop is generally flat and generally horizontal and is positioned near the bottom of the container, thereby creating a space between the bag stop and the bottom of the container. The bag stop additionally has a plurality of holes in it so that air can flow through the holes. The purpose of the bag stop is to support the trash bag, whether empty or full, above the bottom of the container while allowing air to pass between the area of the container below the bag stop and the area of the container above the bag stop.

In a preferred embodiment, two air blowers are located within the container below the bag stop. The air blowers move air between the interior and the exterior of the container in both directions. The first blower (hereinafter referred to as the "sucker") is for the purpose of sucking air out of the interior of the container. The second blower (hereinafter referred to as the "blower") is for the purpose of blowing air into the interior of the container. Tubes connect the sucker and the blower to the exterior of the container via holes in the side wall of the container located below the bag stop.

Therefore, when a user of the trash can apparatus wants to place an empty bag into the trash can, he can use the sucker to suck air out of the interior of the can, thereby causing the flexible bag to quickly conform to the shape of the container and the bag stop. When the user wants to remove a filled bag from the trash can, he can use the blower to blow air into the interior of the can, thereby facilitating removal of the bag by eliminating the partial vacuum that would form as a filled bag is removed.

In a preferred embodiment, the trash can also comprises a foot pedal attached to the exterior of the container near the bottom of the container. The foot pedal operates the sucker and the blower, thereby allowing the user of the apparatus to activate both the sucker and the blower without having to bend over. The trash can additionally comprises a switch for changing the direction of air flow by switching between operation of the sucker and the blower. The switch is preferably located near the top of the container so that the user can operate the switch with his hand without having to bend over.

In another preferred embodiment, the trash can is also designed to handle any liquids that may leak from a trash bag containing trash. In this embodiment, the trash can comprises a bag stop and the sucker and blower as described above. However, the sucker and the blower are not housed within the container itself but instead are housed within a base section attached to the bottom of the container. A hole is located in the bottom of the container for air to move into and out of the container. In a preferred embodiment, the hole is elevated above the bottom of the container by means of a hollow protrusion extending upward from the bottom of the container. Thus, the elevated protrusion creates a reservoir in the bottom of the container to hold any liquids that may leak from a trash bag through the holes in the bag stop. The elevated protrusion has at least one overflow hole in its surface located above the bottom of the container. The overflow hole allows liquids that accumulate in the reservoir to overflow as needed. A liquid drain conduit then conveys the liquids to the exterior of the trash can. Thus, all liquids are directed away from the sucker and blower and associated electrical components.

In this embodiment, the air flows between the interior and the exterior of the container via tubes connected to the sucker and the blower. With respect to the sucker, one end of an air intake tube is positioned at the opening at the top of the elevated protrusion such that air is sucked from the interior of the container from the area below the bag stop. The tube extends down through the elevated protrusion, into the base section, and is connected to the intake of the sucker. An outlet tube connects the discharge of the sucker to the exterior of the trash can via a hole in the side wall of the base section.

With respect to the blower, a tube connects the intake of the blower with the exterior of the trash can via a hole in the side wall of the base section. An outlet tube is connected to the discharge of the blower. The outlet tube extends upward through the elevated protrusion such that it blows air directly into the container in the area below the bag stop.

In a preferred embodiment, the blower outlet tube is connected to the sucker inlet tube. However, the flow paths remain separate and do not cross. The blower outlet tube has a smaller diameter than the sucker inlet tube and is disposed within the sucker inlet tube. The blower outlet tube extends upward through the sucker inlet tube, and the end of the blower outlet tube extends past the end of the sucker inlet tube and into the interior of the container below the bag stop. Thus, the sucker and the blower can be used in tandem to either evacuate air from the container or blow air into the container, depending on whether a bag is being placed into the container or removed from the container.

A preferred embodiment of the invention additionally comprises a method of installing a flexible trash bag in a trash can, as well as a method of removing a flexible trash bag that is filled with trash from a trash can. Each method utilizes a trash receptacle with a built-in blower system as described above. In order to install an empty trash bag in the trash can, a user of the apparatus aligns the opening of the trash bag with the top opening of the container by wrapping the edge of the trash bag opening all the way around the top edge of the opening of the container. The user then simply activates the sucker by pressing on the foot pedal. The bag will then quickly conform to the shape of the container and the bag stop as air is evacuated from the interior of the container. Once the bag is filled with trash, the user can move the switch to change the operation of the foot pedal from activation of the sucker to activation of the blower. The user then presses on the foot pedal to blow air into the container while simultaneously lifting the filled trash bag out of the container. With the blower moving air into the bottom of the container, the filled trash bag will quickly and easily slide out of the container.

DESCRIPTION OF THE DRAWINGS

These and other features, aspects, and advantages of the present invention will become better understood with regard to the following description, appended claims, and accompanying drawings where:

DETAILED DESCRIPTION

In the Summary above and in this Detailed Description, and the claims below, and in the accompanying drawings, reference is made to particular features, including method steps, of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with/or in the context of other particular aspects of the embodiments of the invention, and in the invention generally.

The term "comprises" and grammatical equivalents thereof are used herein to mean that other components, ingredients, steps, etc. are optionally present. For example, an article "comprising" components A, B, and C can contain only components A, B, and C, or can contain not only components A, B, and C, but also one or more other components.

Where reference is made herein to a method comprising two ore more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

As used herein, the term "blower" or "air blower" may refer generally to any device capable of causing air to flow in any direction. However, in specific instances herein, the terms "sucker" and "blower" are used to refer to a generic blower used for the specific purpose of sucking air from the interior of a trash receptacle and to a generic blower used for the specific purpose of blowing air into the interior of a trash receptacle, respectively.

Figure 1:
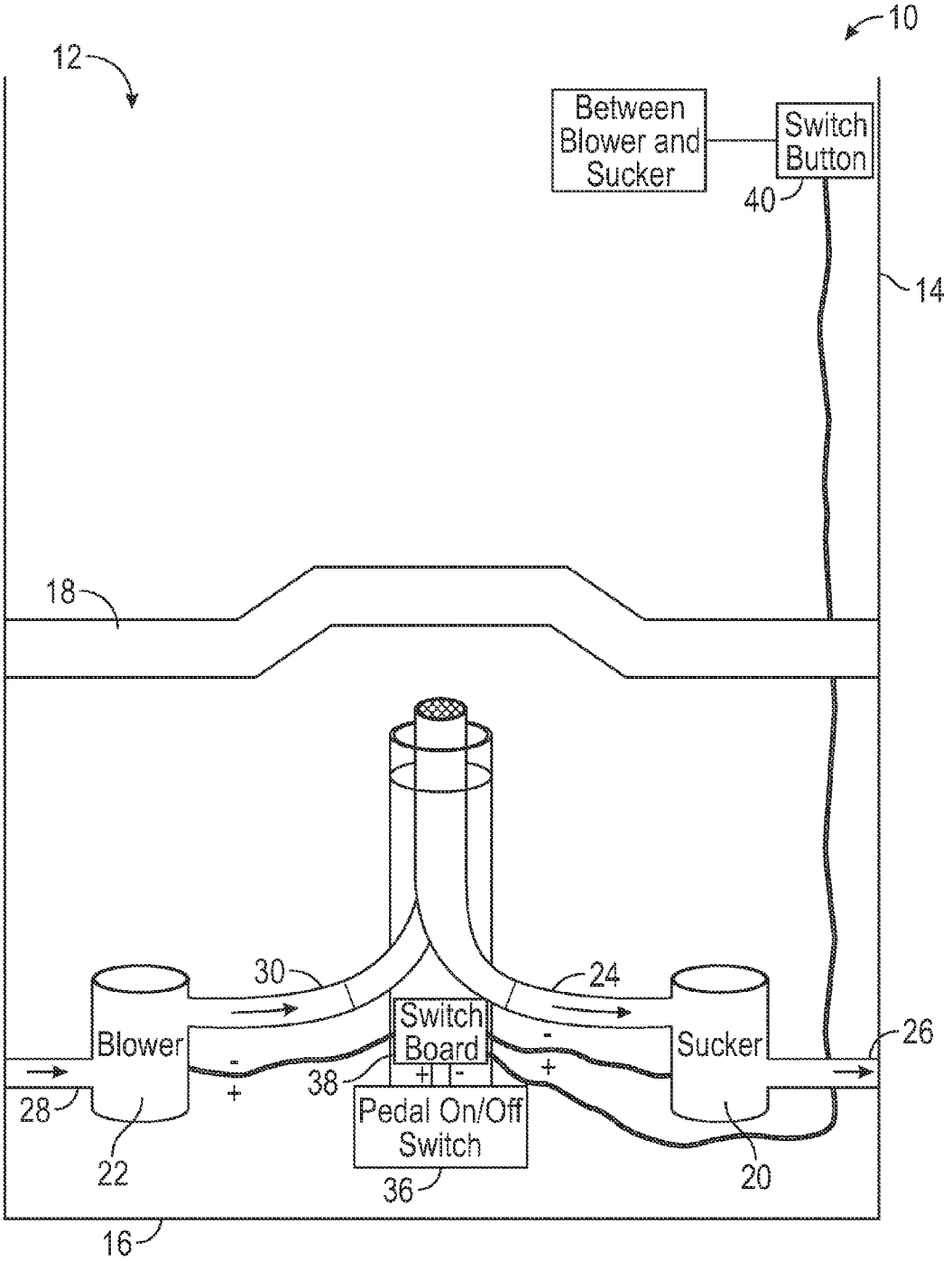
FIG. 1 is a side sectional view of a trash receptacle embodying features of the present invention, also depicting the interior of a trash receptacle embodying features of the present invention.
Figure 2:
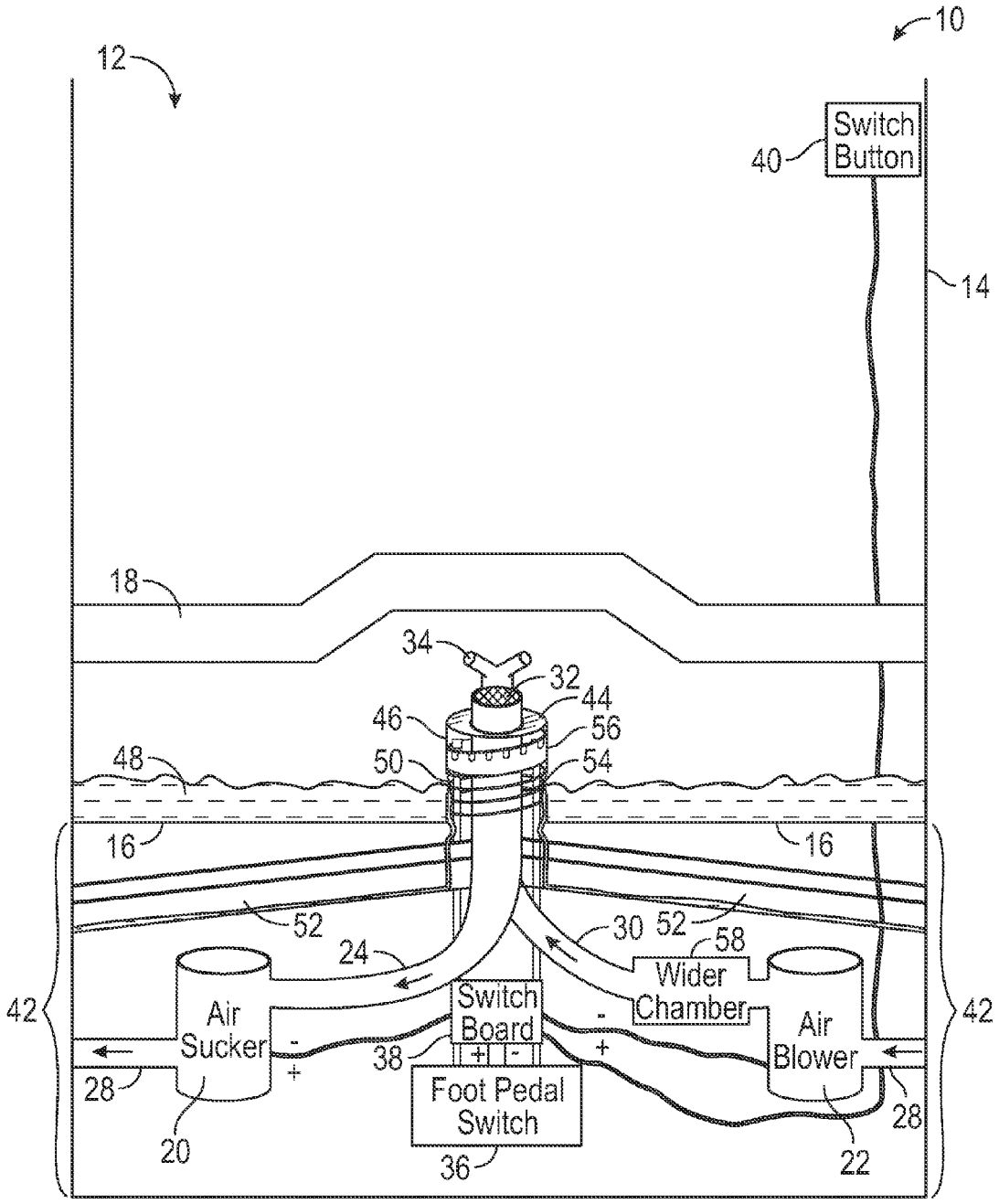
FIG. 2 is a side sectional view of a trash receptacle embodying features of the present invention, also depicting the interior of a trash receptacle embodying features of the present invention.
Figure 3:
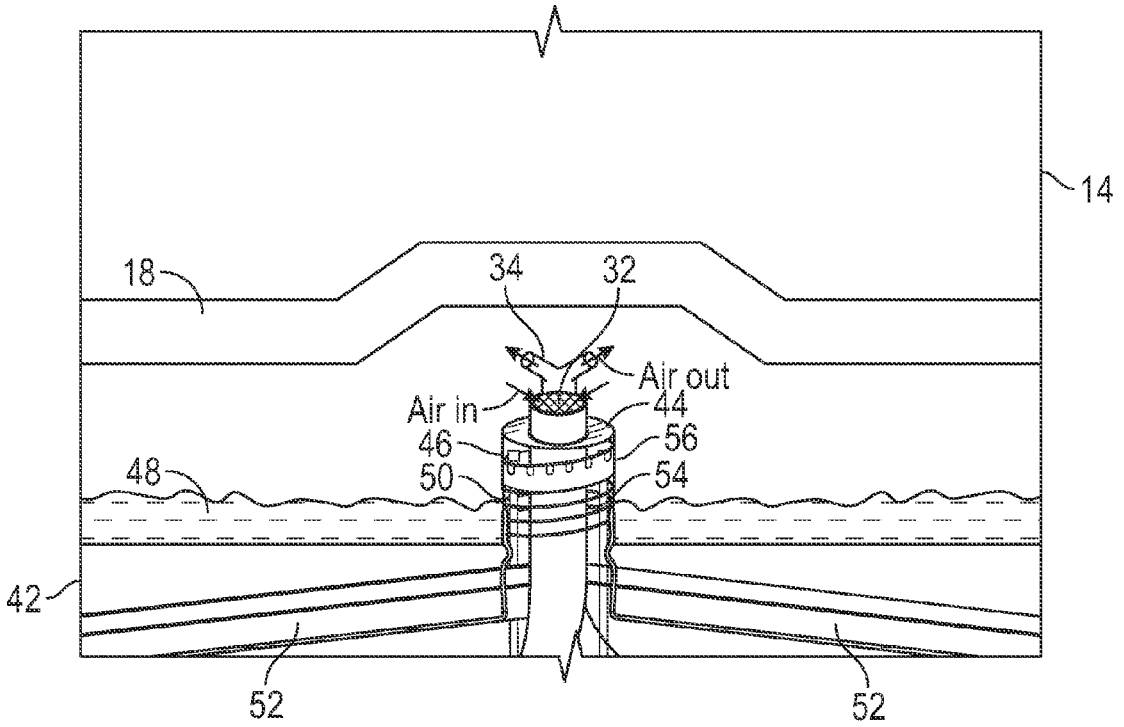
FIG. 3 is a partial view of the apparatus depicted in FIG. 2.

Turning now to the drawings, FIGS. 1-3 illustrate preferred embodiments of the invention. A preferred embodiment of the invention is directed generally to a pneumatic trash can and, more specifically, to a trash can having a built-in blower system capable of sucking air from the inside of the trash can as well as blowing air into the inside of the trash can. A user of the device can suck air out of the inside of the trash can when placing a flexible trash bag into the trash can in order to easily conform the bag to the inside of the can. Additionally, the user can blow air into the trash can when removing a filled trash bag from the can in order to easily remove the filled bag.

In a preferred embodiment, the trash can or trash receptacle of the present invention comprises a container 10 for accepting and holding a flexible trash bag. The container 10 comprises a top opening 12, a continuous side wall 14, and a bottom 16. In a preferred embodiment, the side wall 14 forms a circular shape; however, the side wall 14 may form a rectangular shape or other similar shape.

The trash can further comprises a bag stop 18 disposed within the container 10. The bag stop 18 comprises a surface attached to the continuous side wall 14 of the container 10. In a preferred embodiment, the bag stop 18 is generally flat and generally horizontal. The bag stop 18 is positioned near the bottom 16 of the container 10, thereby creating a space between the bag stop 18 and the bottom 16 of the container 10. The bag stop 18 additionally has a plurality of holes (not shown) in it such that air can flow through the holes. Thus, the area of the container 10 below the bag stop 18 remains in fluid communication with the area of the container 10 above the bag stop 18. The purpose of the bag stop 18 is to support the trash bag, whether empty or filled, above the bottom 16 of the container 10 while also allowing air to pass between the area of the container 10 below the bag stop 18 and the area of the container 10 above the bag stop 18.

In a preferred embodiment, the trash can further comprises two air blowers. As illustrated in FIG. 1, the air blowers are disposed within the container 10 below the bag stop 18. The blowers are used to move air between the interior and the exterior of the container 10. One blower 20 (hereinafter referred to as "air sucker" or "sucker") is used to suck air from the interior of the container 10 and move the air to the exterior of the container 10. The second blower 22 (hereinafter referred to as "air blower" or "blower") is used to blow air from the exterior of the container 10 into the interior of the container 10. Thus, the sucker 20 is used when placing an empty trash bag into the container 10, and the blower 22 is used when removing a filled trash bag from the container 10. When the user activates the sucker 20, it evacuates air located between the empty trash bag and the interior of the side wall 14 of the container 10, thereby causing the trash bag to quickly conform to the shape of the container 10 and the bag stop 18. When the user activates the blower 22, it blows air into the interior of the container 10, thereby facilitating removal of a filled trash bag by eliminating the partial vacuum that would form as a filled bag is lifted out of the container 10.

The sucker 20 sucks air from the interior of the container 10 via a sucker inlet tube 24 and moves the air to the exterior of the container 10 via a sucker outlet tube 26. The sucker outlet tube 26 is connected to a first hole in the side wall 14 of the container 10 such that the air can be moved to the exterior of the container 10. The hole in the side wall 14 is sealed around the sucker outlet tube 26 such that no air escapes the container 10 from the area around the hole in the side wall 14.

Similarly, a blower inlet tube 28 is connected to a second hole in the side wall 14 of the container 10 and extends to the blower intake. The second hole in the side wall 14 is also sealed around the blower inlet tube 28. The blower 22 discharges air into the interior of the container 10 via a blower outlet tube 30. Thus, the blower 22 transfers air from the exterior of the container 10 into the interior of the container 10 below the bag stop 18.

The trash can further comprises a foot pedal 36 located exterior to the container 10 near the bottom 16 of the container 10. The foot pedal 36 is electrically connected to both the sucker 20 and the blower 22. The user of the device can depress the foot pedal 36 with his foot and thereby activate either the sucker 20 or the blower 22, depending on whether the user is placing an empty bag into the container 10 or removing a filled bag from the container 10.

In a preferred embodiment, a switch 40 is located exterior to the container 10 near the top opening 12 of the container 10 such that the user can operate the switch 40 without having to bend over. The switch 40 is electrically connected to a switch board 38, which allows the user to alternate between activation of the sucker 20 and activation of the blower 22 when depressing the foot pedal 36. Thus, only the sucker 20 or the blower 22 may be activated at any given time by depressing the foot pedal 36. The sucker 20 and the blower 22 can not be activated simultaneously.

An alternative embodiment (not shown) comprises two foot pedals. One pedal activates the sucker, and the second pedal activates the blower. In this embodiment, the switch is unnecessary.

In an alternative preferred embodiment of the present invention, the trash can further comprises features allowing the device to drain away any liquids that may leak from a filled trash bag to the exterior of the trash can such that the liquids do not come into contact with the sucker 20 or the blower 22 and associated electrical components. In this preferred embodiment, as illustrated in FIGS. 2-3, the trash can comprises a bag stop 18 disposed within a container 10 having a top opening 12, a continuous side wall 14, and a bottom 16, as described above. However, in this embodiment, the trash can further comprises a base section 42 attached to the bottom 16 of the container 10. As viewed from the exterior of the trash can apparatus, the base section 42 appears to simply be a continuation of the container 10. In a preferred embodiment, the side wall 14 of the container 10 extends downward below the bottom 16 of the container 10 and also forms the side wall 14 of the base section 42. However, the base section 42 is located below the bottom 16 of the container 10 and has a volume distinct from that of the container 10.

In this embodiment, as illustrated in FIG. 2, the sucker 20 and the blower 22 are housed within the base section 42, not within the container 10 itself. In this embodiment, the trash can also comprises a foot pedal 36 and a switch 40 for operating both the sucker 20 and the blower 22, as described above. However, the pedal 36 is located exterior to the base section 42 near the bottom end of the base section 42, i.e., near the ground on which the trash can apparatus rests when the apparatus is in an upright position.

The base section 42 is connected to the interior of the container 10 through an opening 44 in the bottom 16 of the container 10. In a preferred embodiment, the bottom opening 44 is elevated above the bottom 16 of the container 10 by a hollow protrusion 46 extending upward from the bottom 16 of the container 10. The extended hollow protrusion 46 creates a reservoir 48 at the bottom of the container 10. The reservoir 48 holds any liquids that may leak from a punctured trash bag through the holes in the bag stop 18.

The hollow protrusion 46 is comprised of at least one overflow hole 50, and preferably two or more overflow holes 50 around the exterior surface of the protrusion 46. In a preferred embodiment, the overflow holes 50 are located at approximately the halfway point along the vertical length of the protrusion 46, although the holes 50 may be located at any point on the surface of the protrusion 46. Thus, the depth of the liquid reservoir 48 is approximately equal to the distance between the bottom 16 of the container 10 and the overflow holes 50. As excess liquids fill the reservoir 48, the liquids overflow through the holes 50.

Once the liquid flows through the overflow holes 50, the liquid then falls by gravity into at least one drain, and preferably two drains 52. The drains 52 are disposed within the base section 42 and convey the liquids to the exterior of the trash can. The drains 52 allow the user of the trash can to direct leaked liquids to a desired location, such as an external drain on the property where the trash can apparatus is located. Thus, the drains 52 help to keep liquids from leaking onto unwanted areas when a filled trash bag is transferred out of the trash can. The drains 52 also eliminate the need for the user to turn over the trash can to dump liquids that may accumulate in the bottom of the can. Furthermore, the drains 52 keep liquids from coming into contact with the sucker 20 or the blower 22 and associated electrical components.

The air is conveyed between the interior and the exterior of the container through tubes. Both the sucker 20 and the blower 22 have inlet tubes 24, 28 and outlet tubes 26, 30, connected to the intake and the discharge of the sucker 20 and the blower 22, respectively. The sucker inlet tube 24 has two ends. The first end 32 is positioned at the opening 44 at the top of the protrusion 46. This end 32 is the location where air inside the container 10 enters the inlet tube 24 such that the air is sucked from the interior of the container 10 and moved to the exterior of the container 10 when the sucker 20 is used to conform an empty trash bag to the shape of the container 10.

The diameter of the sucker inlet tube 24 is smaller than the diameter of the hollow protrusion 46, thereby leaving an annular space between the outside of the sucker inlet tube 24 and the inside of the protrusion 46. The top end of the protrusion 46 is sealed around the end 32 of the sucker inlet tube 24 so that air can not pass through the protrusion 46 around the outside of the sucker inlet tube 24. The sucker inlet tube 24 extends downward through the protrusion 46 and into the base section 42. The second end of the tube 24 is connected to the intake of the sucker 20. The air is discharged from the sucker 20 through the sucker outlet tube 26, which is connected to a hole in the side wall 14 where the air exits the trash can apparatus.

In a preferred embodiment, as illustrated in FIG. 2, the sucker inlet tube 24 is interconnected with the blower outlet tube 30. The blower outlet tube 30 is connected to the blower 22 discharge at one end. The blower outlet tube 30 extends from the blower 22 discharge and connects with the sucker inlet tube 24. However, the air flow paths of the sucker inlet tube 24 and the blower outlet tube 30 remain separate and do not cross. The blower outlet tube 30 extends into the sucker inlet tube 24 through a hole in the surface of the sucker inlet tube 24. The blower outlet tube 30 has a smaller diameter than the sucker inlet tube 24 and is disposed within the sucker inlet tube 24. Once the blower outlet tube 30 connects to the sucker inlet tube 24, it extends upward through the sucker inlet tube 24 and into the interior of the container 10 in the area below the bag stop 18. The end 34 of the blower outlet tube 30 extends past the end 32 of the sucker inlet tube 24 and is the point where air is discharged from the blower 22 into the interior of the container 10 when the blower is used to add air pressure to the interior of the container 10 during the removal of a filled trash bag.

Therefore, an annular space is created between the interior of the sucker inlet tube 24 and the exterior of the blower outlet tube 30. When the sucker 20 is activated, air is sucked from the interior of the container 10 and flows through this annular space to the sucker 20 intake before being discharged to the exterior of the trash can apparatus via the sucker outlet tube 26.

The blower inlet tube 28 is connected at one end to a hole in the side wall 14 of the base section 42 and at the other end to the blower 22 intake. Thus, the blower inlet tube 28 allows the blower 22 to suck air from the exterior of the trash can and blow the air into the interior of the container 10 below the bag stop 18.

In a preferred embodiment, the blower outlet tube 30 comprises a section or chamber 58 that is wider than the rest of the tube 30. In addition, the end 34 of the blower outlet tube 30 has a narrow opening. These features allow the blower 22 to blow air into the interior of the container 10 at a high velocity, thereby facilitating the ease of removing a heavy bag that is filled with trash.

In a preferred embodiment, the bottom opening 44 located at the top end of the protrusion 46 is located in a position approximately in the center of the bottom of the container 10. Thus, as illustrated in FIGS. 2-3, the end 32 of the sucker inlet tube 24 and the end 34 of the blower outlet tube 30 are also located approximately in the center of the bottom of the container 10. In a preferred embodiment, the bag stop 18 does not have holes near the center of the bag stop 18. Instead, the holes are located concentrically around a central area of the bag stop 18. Therefore, if any liquids leak from a punctured trash bag, the liquids will not fall into the sucker inlet tube 24 or the blower outlet tube 30 and contact the sucker 20 or the blower 22.

In a preferred embodiment, as illustrated in FIG. 2-3, the trash can further comprises a spring 54 and an overflow hole cover 56. Because the overflow holes 50 drain liquid to the exterior of the trash can, air can move through the overflow holes 50 between the interior and the exterior of the trash can when either the sucker 20 or the blower 22 is activated. However, the sucker 20 works most efficiently in conforming an empty trash bag to the shape of the container 10 when substantially all of the air that it takes in is sucked from the interior of the container 10. Similarly, the blower 22 works most efficiently in bag removal when substantially all of the air that it discharges remains in the interior of the container 10. Therefore, it is advantageous to cover the overflow holes 50 during the times when either the sucker 20 or the blower 22 is activated. The spring 54 and the overflow hole cover 56 solve this problem.

In a preferred embodiment, the spring 54 is disposed within the hollow protrusion 46 in the annular space between the outside of the sucker inlet tube 24 and the inside of the protrusion 46. The overflow hole cover 56 is in the shape of a ring and is also disposed within the annular space between the outside of the sucker inlet tube 24 and the inside of the protrusion 46. The overflow hole cover 56 is attached to the top end of the spring 54. When the spring 54 becomes compressed, the overflow hole cover 56 moves downward and covers the overflow holes 50. The spring 54 is operatively connected to the foot pedal 36. When the foot pedal 36 is depressed by the user's foot, thereby activating either the sucker 20 or the blower 22, the spring 54 moves into a compressed state and the overflow hole cover 56 covers the overflow holes 50. Thus, the overflow holes 50 are covered whenever the sucker 20 or the blower 22 is in use, thereby increasing the efficiency of both the sucker 20 and the blower 22.

In a preferred embodiment, the air discharged by the blower 22 into the interior of the container 10 is scented. In a preferred embodiment, a scented insert (not shown) is positioned in either the blower inlet tube 28 or the blower outlet tube 30. The insert comprises a scented filter that the air must pass through before it enters the interior of the container 10. Because the blower 22 is used when removing a filled trash bag, which often has a bad odor, the scented air will make the task or removing a filled trash bag from the trash can more pleasant for the user by masking at least a portion of any bad odors originating from the filled trash bag.

In an alternative embodiment (not shown in the drawings), the present invention is comprised of only one air blower having the capability of blowing air in two directions. In this alternative embodiment, there is only one tube connecting the air blower to the exterior of the trash can and only one tube disposed within the container below the bag stop. The air blower in this embodiment can be used to suck air from the interior of the container as well as to blow air into the interior of the container. This embodiment is comprised of a single foot pedal for operating the air blower, as described above, as well as a switch for changing the direction of air flow depending on whether the user is placing an empty bag into the container or removing a filled bag from the container.

A preferred embodiment of the present invention further comprises a method of installing a flexible trash bag in a trash can, as well as a method of removing a flexible trash bag filled with trash from a trash can. Each method utilizes a trash can apparatus comprising a container 10 for accepting a flexible trash bag. As described above, the container 10 is comprised of a top opening 12, a continuous side wall 14, and a bottom 16. The apparatus is further comprised of a bag stop 18 disposed within the container for the purpose of supporting a trash bag, whether empty or filled, above the bottom 16 of the container 10 while also allowing air to pass through the bag stop 18 via a plurality of holes in the surface of the bag stop 18. The apparatus is comprised of at least one air blower, and preferably two air blowers. The two air blowers are comprised of a sucker 20 for evacuating air from the interior of the container 10 and a blower 22 for blowing air into the interior of the container 10.

In order to install a trash bag in the trash can, the user must first supply an existing flexible trash bag having an opening. The user then aligns the opening of the trash bag with the top opening 12 of the container 10 by wrapping the edge of the trash bag opening around the edge of the top opening 12 of the container 10. The user then activates the sucker 20 using a foot pedal 36. The air trapped inside the container 10 between the outer surface of the trash bag and the interior of the side wall 14 will be at least partially evacuated from the interior of the container 10, thereby causing the trash bag to quickly and conveniently conform to the shape of the container 10 and the bag stop 18. Thus, the user does not have to bend down and reach into the container 10 in order to manually conform the bag to the shape of the container 10. In addition, with the bag conformed to the shape of the container 10, all of the space inside the bag can be efficiently utilized for holding trash.

In order to remove a trash bag filled with trash from the trash can, the user will activate the blower 22 using the foot pedal 36. The blower 22 will blow air into the interior of the container 10 below the bag stop 18 while the user simultaneously lifts the filled trash bag out of the container 10. Because air is blowing into the container 10 below the filled trash bag, a partial vacuum will not be created as the filled bag is lifted out of the container 10. Thus, the trash can will quickly and easily slide away from the filled trash bag without the user having to hold the heavy trash bag and wait for the trash can to slide off.

It is understood that versions of the invention may come in different forms and embodiments. Additionally, it is understood that one of skill in the art would appreciate these various forms and embodiments as falling within the scope of the invention as disclosed herein.

What I claim as my invention is:

1. A trash receptacle comprising:

a. a container for accepting a flexible trash bag, said container having a top opening, a continuous side wall, and a bottom;

b. a bag stop disposed within the container for supporting a trash bag above the bottom of the container, said bag stop comprising a surface attached to the side wall, said surface having a plurality of holes therethrough;

c. two air blowers disposed within the container below the bag stop, wherein the first air blower is adapted to move air into the interior of the container and the second air blower is adapted to evacuate air from the interior of the container, wherein the air blowers are configured for moving air between the interior of the container and the exterior of the container in both directions via at least one hole in the side wall below the bag stop; and, d. at least one foot pedal located exterior to the container near the bottom of the container, said at least one foot pedal configured for operating the air blowers.

2. The trash receptacle of claim 1, further comprising a switch for switching operation between the two blowers such that air will move in only one direction at a time.

3. The trash receptacle of claim 1, said air moving into the interior of the container being scented.

4. A trash receptacle comprising:

a. a container for accepting a flexible trash bag, said container having a top opening, a continuous side wall, and a bottom, said bottom having an opening therethrough;

b. a bag stop disposed within the container for supporting a trash bag above the bottom of the container, said bag stop comprising a surface attached to the side wall, said surface having a plurality of holes therethrough;

c. a base section attached to the bottom of the container; and, d. at least one air blower disposed within the base section, said at least one air blower configured for moving air between the interior of the container and the exterior of the container in both directions by moving air through the opening in the bottom of the container, wherein the opening in the bottom of the container is elevated above the bottom of the container by means of a hollow protrusion extending upward from the bottom of the container such that a liquid reservoir is formed in the bottom of the container for capturing substantially all liquids that may pass through the holes in the bag stop surface, the depth of said reservoir being generally equal to the height of the hollow protrusion extending upward from the bottom of the container.

5. The trash receptacle of claim 4, said air moving into the interior of the container being scented.

6. The trash receptacle of claim 4, further comprising at least one tubular conduit connecting the at least one air blower with the interior of the container, said tubular conduit passing through the hollow protrusion extending upward from the bottom of the container.

7. The trash receptacle of claim 6, said bag stop configured such that no holes are located in the area of the bag stop directly above the opening in the bottom of the container, thereby preventing any liquids from flowing through the holes in the bag stop into the tubular conduit connected to the at least one air blower.

8. The trash receptacle of claim 4, said hollow protrusion having at least one overflow hole in the surface of the protrusion such that liquid accumulation in the reservoir overflows through said at least one overflow hole.

9. The trash receptacle of claim 8, further comprising at least one drain conduit connected to said overflow hole, said drain conduit configured to convey overflow liquids to the exterior of the container such that no liquids contact the blower located within the base section of the trash receptacle.

10. The trash receptacle of claim 9, further comprising at least one foot pedal configured for activating the at least one air blower by depressing the pedal, and further comprising a spring-activated cover for substantially covering the at least one overflow hole, said cover being operatively connected to the at least one foot pedal such that the overflow hole is not covered when the foot pedal is not depressed and is covered when the foot pedal is depressed, thereby creating suction within the container when the at least one air blower is activated to evacuate air from the interior of the container by depressing the foot pedal.

11. The trash receptacle of claim 4, further comprising at least one foot pedal located exterior to the base section of the container, said foot pedal configured for activating said at least one air blower by depressing the pedal.

12. The trash receptacle of claim 11, further comprising a switch for changing the direction of air flow from the air blower.

13. The trash receptacle of claim 11, comprising two air blowers operated by the at least one foot pedal, the first air blower adapted to move air into the interior of the container and the second air blower adapted to evacuate air from the interior of the container.

14. The trash receptacle of claim 13, further comprising a switch for switching operation between the two blowers such that air will move in only one direction at a time.

* * * * *